US008844142B2

(12) United States Patent
Kammer

(10) Patent No.: US 8,844,142 B2
(45) Date of Patent: Sep. 30, 2014

(54) ADJUSTABLE COMB ASSEMBLY FOR HAIR CUTTING APPLIANCE

(75) Inventor: Carl Gottfried Kammer, Middleton, WI (US)

(73) Assignee: Spectrum Brands, Inc., Middleton, WI (US)

( * ) Notice: Subject to any disclaimer, the term of this patent is extended or adjusted under 35 U.S.C. 154(b) by 363 days.

(21) Appl. No.: 13/051,066

(22) Filed: Mar. 18, 2011

(65) Prior Publication Data

US 2012/0233865 A1 Sep. 20, 2012

(51) Int. Cl.
*B26B 19/20* (2006.01)
*B26B 19/38* (2006.01)

(52) U.S. Cl.
CPC ..... *B26B 19/20* (2013.01); *B26B 19/3846* (2013.01)
USPC ..... 30/201; 30/233.5

(58) Field of Classification Search
USPC ..... 30/200, 201, 202, 233, 286, 289, 233.5
See application file for complete search history.

(56) References Cited

U.S. PATENT DOCUMENTS

| | | | | |
|---|---|---|---|---|
| 2,731,720 | A | 1/1956 | Henard | |
| 2,933,809 | A | 4/1960 | McWilliams | |
| 2,959,853 | A * | 11/1960 | Mercer | 30/31 |
| 3,106,775 | A | 10/1963 | Lew | |
| 3,183,538 | A | 5/1965 | Hubner | |
| 3,387,367 | A | 6/1968 | Merzon | |
| 3,747,594 | A | 7/1973 | Bishop | |
| 3,967,372 | A | 7/1976 | Beck et al. | |
| 4,184,088 | A | 1/1980 | Richert | |
| 4,776,095 | A | 10/1988 | Tsujimoto et al. | |
| 4,845,852 | A * | 7/1989 | Sukow | 30/201 |
| 4,949,460 | A | 8/1990 | Sterk | |
| 5,050,305 | A | 9/1991 | Baker et al. | |
| 5,075,971 | A | 12/1991 | McCambridge | |
| 5,084,974 | A | 2/1992 | Sukow et al. | |
| 5,105,541 | A | 4/1992 | Messinger et al. | |
| 5,131,147 | A | 7/1992 | Plevyak et al. | |
| 5,259,115 | A | 11/1993 | Bluder et al. | |
| 5,327,648 | A | 7/1994 | Ullmann | |
| 5,579,581 | A | 12/1996 | Melton | |
| 5,611,804 | A | 3/1997 | Heintke et al. | |
| 5,898,999 | A | 5/1999 | Chaouachi et al. | |
| 5,979,060 | A | 11/1999 | Holzbauer et al. | |
| 6,079,103 | A | 6/2000 | Melton et al. | |

(Continued)

FOREIGN PATENT DOCUMENTS

| | | | |
|---|---|---|---|
| DE | 19617448 | A1 | 11/1997 |
| EP | 0325326 | A1 | 7/1989 |

(Continued)

*Primary Examiner* — Stephen Choi
(74) *Attorney, Agent, or Firm* — Armstrong Teasdale LLP

(57) ABSTRACT

An adjustable comb assembly, which is attachable to an electric hair cutting appliance of the type including opposing cutting blades defining a cutting edge margin for cutting hair, includes a plurality of teeth for regulating a haircut length resulting from the hair being cut by the cutting edge margin of the electric hair cutting appliance. The teeth are selectively movable relative to the cutting edge of the electric hair cutting appliance to any one of a substantially infinite number of different haircut length positions within a range from a maximum haircut length position, in which the comb assembly facilitates cutting hair to a maximum haircut length, to a minimum haircut length position, in which the comb assembly facilitates cutting hair to a minimum haircut length.

26 Claims, 8 Drawing Sheets

(56) References Cited

U.S. PATENT DOCUMENTS

| | | | | |
|---|---|---|---|---|
| 6,260,276 | B1 | 7/2001 | Lebherz et al. | |
| 6,378,210 | B1 | 4/2002 | Bickford | |
| 6,578,269 | B2 | 6/2003 | Wilcox et al. | |
| 6,618,948 | B2 | 9/2003 | Lin | |
| 6,665,938 | B2 | 12/2003 | McCambridge et al. | |
| 6,836,965 | B1 | 1/2005 | Ross | |
| 6,968,623 | B2 | 11/2005 | Braun et al. | |
| 7,114,257 | B1 | 10/2006 | Ortega | |
| D544,999 | S | 6/2007 | Prat-Pfister | |
| D549,873 | S | 8/2007 | Prat-Pfister | |
| 7,426,785 | B2 | 9/2008 | Ho | |
| 7,690,117 | B2 | 4/2010 | Rogatschnig | |
| 7,748,123 | B2 | 7/2010 | Bednar | |
| 7,877,880 | B2 | 2/2011 | Royle | |
| 8,079,149 | B2 | 12/2011 | Bednar | |
| D651,746 | S | 1/2012 | Prat-Pfister | |
| 8,141,253 | B2 | 3/2012 | Royle | |
| 8,171,942 | B2 | 5/2012 | Poran | |
| 8,328,821 | B2 | 12/2012 | Sanchez-Martinez et al. | |
| D675,379 | S | 1/2013 | Yoon | |
| D675,380 | S | 1/2013 | Yoon | |
| 2003/0233754 | A1 | 12/2003 | Braun et al. | |
| 2005/0044719 | A1* | 3/2005 | Nakakura et al. | 30/196 |
| 2005/0246902 | A1* | 11/2005 | Poran | 30/201 |
| 2006/0123633 | A1 | 6/2006 | Hauer | |
| 2008/0034591 | A1 | 2/2008 | Fung | |
| 2008/0040927 | A1 | 2/2008 | Lau | |
| 2008/0196252 | A1 | 8/2008 | Mikula et al. | |
| 2008/0209733 | A1 | 9/2008 | Johnson | |
| 2008/0282550 | A1 | 11/2008 | Piwaron | |
| 2009/0223056 | A1 | 9/2009 | Wilson et al. | |
| 2010/0083508 | A1 | 4/2010 | Cheng | |
| 2010/0198134 | A1 | 8/2010 | Eckhouse et al. | |
| 2010/0325892 | A1 | 12/2010 | Nuber | |
| 2012/0233865 | A1 | 9/2012 | Kammer | |
| 2012/0240414 | A1 | 9/2012 | Wevers et al. | |
| 2012/0272533 | A1 | 11/2012 | Sobagaki et al. | |
| 2013/0104401 | A1 | 5/2013 | Rodriguez | |
| 2013/0144280 | A1 | 6/2013 | Eckhouse et al. | |
| 2013/0219724 | A1 | 8/2013 | Werner | |
| 2013/0239416 | A1 | 9/2013 | Wevers et al. | |
| 2013/0263457 | A1 | 10/2013 | Sobagaki et al. | |

FOREIGN PATENT DOCUMENTS

| | | | |
|---|---|---|---|
| EP | 0928670 | B1 | 6/2005 |
| EP | 1880811 | A1 | 1/2008 |
| EP | 1866129 | B1 | 11/2009 |
| GB | 1021836 | A | 3/1966 |
| JP | 54143372 | * | 11/1979 |
| WO | 0249813 | A1 | 6/2002 |
| WO | 2008028332 | A1 | 3/2008 |
| WO | 2008099281 | A2 | 8/2008 |
| WO | 2013080114 | A1 | 6/2013 |

* cited by examiner

ADJUSTABLE COMB ASSEMBLY FOR HAIR CUTTING APPLIANCE

FIELD OF THE DISCLOSURE

The field of the present disclosure relates generally to an adjustable comb assembly for a hair cutting appliance, such as those used for hair trimming, clipping and shaving.

BACKGROUND

Electric hair cutting appliances come in a number of different types depending on the intended use of the appliance, such as for trimming facial or body hair, clipping the hair on one's head or on a pet, or for shaving facial or body hair. Such hair cutting appliances typically have at least one stationary blade and at least one reciprocating blade. Each of the blades includes a plurality of shearing teeth defining a cutting edge margin. The shearing teeth of the reciprocating blade overlie, in face-to-face contact with, the shearing teeth of the stationary blade. The reciprocating blade is operatively connected to an eccentric drive assembly such that rotation of the drive assembly linearly reciprocates the reciprocating blade relative to the stationary blade so that the shearing teeth of the reciprocating blade reciprocate across the shearing teeth of the stationary blade, thereby producing shearing action between the reciprocating blade teeth and the stationary blade teeth.

Some hair cutting appliances include at least one comb, also known as a guard. The comb includes a plurality of teeth that are positioned generally adjacent to the cutting edge margin of the hair cutting appliance. In use, the hair cutting appliance is positioned so that the comb is in contact with the subject's skin, and the hair cutting appliance is moved relative to the hair so that the comb remains in contact with the subject's skin. As the hair cutting appliance is moved, the comb directs the hair toward the cutting edge margin of the hair cutting appliance. The comb is configured to maintain the cutting edge margin of the hair cutting appliance at a selected distance from the subject's skin so that the comb, in effect, regulates the length of hair cut by the hair cutting appliance to facilitate cutting the hair to a desired length.

In one example of a hair cutting appliance, a plurality of interchangeable combs are provided to allow hair to be cut to different haircut lengths. In effect, each comb corresponds to one of a variety of different haircut lengths. Each comb is removably and repeatedly attachable to the hair cutting appliance. Thus, in this type of hair cutting appliance, the user must chose a haircut length from a plurality of discrete, preselected haircut lengths, and then the user must locate the appropriate comb that corresponds to the selected haircut length and attach the selected comb to the hair cutting appliance.

In another example, the comb is adjustable to different haircut length positions such that a single comb facilitates cutting hair to different haircut lengths. In such an example, the comb is selectively movable, relative to the cutting edge margin of the hair cutting appliance, to a discrete, preselected number of haircut length positions to facilitate cutting hair to a discrete, preselected number of haircut lengths. The user can only cut hair to one of these discrete, preselected haircut lengths. Thus, the functionality of the hair cutting appliance is inherently limiting, much like the type of hair cutting appliance that includes a plurality of different combs.

SUMMARY

In one aspect, an adjustable comb assembly, which is attachable to an electric hair cutting appliance of the type including opposing cutting blades defining a cutting edge margin for cutting hair, generally comprises a plurality of teeth for regulating a haircut length resulting from the hair being cut by the cutting edge margin of the electric hair cutting appliance. When the adjustable comb assembly is attached to the electric hair cutting appliance, the teeth are selectively movable relative to the cutting edge of the electric hair cutting appliance to any one of a substantially infinite number of different haircut length positions within a range from a maximum haircut length position, in which the comb assembly facilitates cutting hair to a maximum haircut length, to a minimum haircut length position, in which the comb assembly facilitates cutting hair to a minimum haircut length, to thereby allow selective adjustment of the haircut length to any one of a substantially infinite number of different haircut lengths within a range from the maximum haircut length to the minimum haircut length.

In another aspect, an adjustable comb assembly, which is attachable to an electric hair cutting appliance of the type including opposing cutting blades defining a cutting edge margin for cutting hair, generally comprises a plurality of teeth for regulating a haircut length resulting from the hair being cut by the cutting edge margin of the electric hair cutting appliance. When the adjustable comb assembly is attached to the electric hair cutting appliance, the teeth are selectively movable relative to the cutting edge of the electric hair cutting appliance to any one of a plurality of haircut length positions within a range from a maximum haircut length position, in which the comb assembly facilitates cutting hair to a maximum haircut length, to a minimum haircut length position, in which the comb assembly facilitates cutting hair to a minimum haircut length, to thereby allow selective adjustment of the haircut length to any one of a plurality of different haircut lengths within a range from the maximum haircut length to the minimum haircut length. A drive assembly for selectively moving the teeth to the any one of the plurality of different haircut length positions within the range from the maximum haircut length position to the minimum haircut length position includes a rack-and-pinion transmission operatively coupled to the teeth. The pinion of the rack-and-opinion transmission includes a worm screw.

In yet another aspect, a hair cutting appliance for cutting hair to a selected haircut length generally comprises a housing having a hair cutting end margin, and an electric motor disposed within the housing. At least two opposing cutting blades at the hair cutting end of the housing together define a cutting edge margin of the hair cutting appliance. At least one of the cutting blades is operatively coupled to the electric motor and is adapted for reciprocating movement relative to the other cutting blade for cutting hair at the cutting edge margin. An adjustable comb assembly of the hair cutting appliance includes a plurality of teeth for regulating a haircut length resulting from the hair being cut by the cutting edge margin of the electric hair cutting appliance. When the adjustable comb assembly is attached to the electric hair cutting appliance, the teeth are selectively movable relative to the cutting edge of the electric hair cutting appliance to any one of a substantially infinite number of different haircut length positions within a range from a maximum haircut length position, in which the comb assembly facilitates cutting hair to a maximum haircut length, to a minimum haircut length position, in which the comb assembly facilitates cutting hair to a minimum haircut length, to thereby allow selective adjustment of the haircut length to any one of a substantially infinite number of different haircut lengths within a range from the maximum haircut length to the minimum haircut length. A drive assembly of the hair cutting appliance, for selectively moving the teeth to said any one of the substantially infinite number of different haircut length positions within the range from the maximum haircut length position to the minimum haircut length position, includes a rack-and-pinion transmission operatively coupled to the teeth, wherein the pinion of the rack-and-opinion transmission includes a worm screw.

Figure 4:
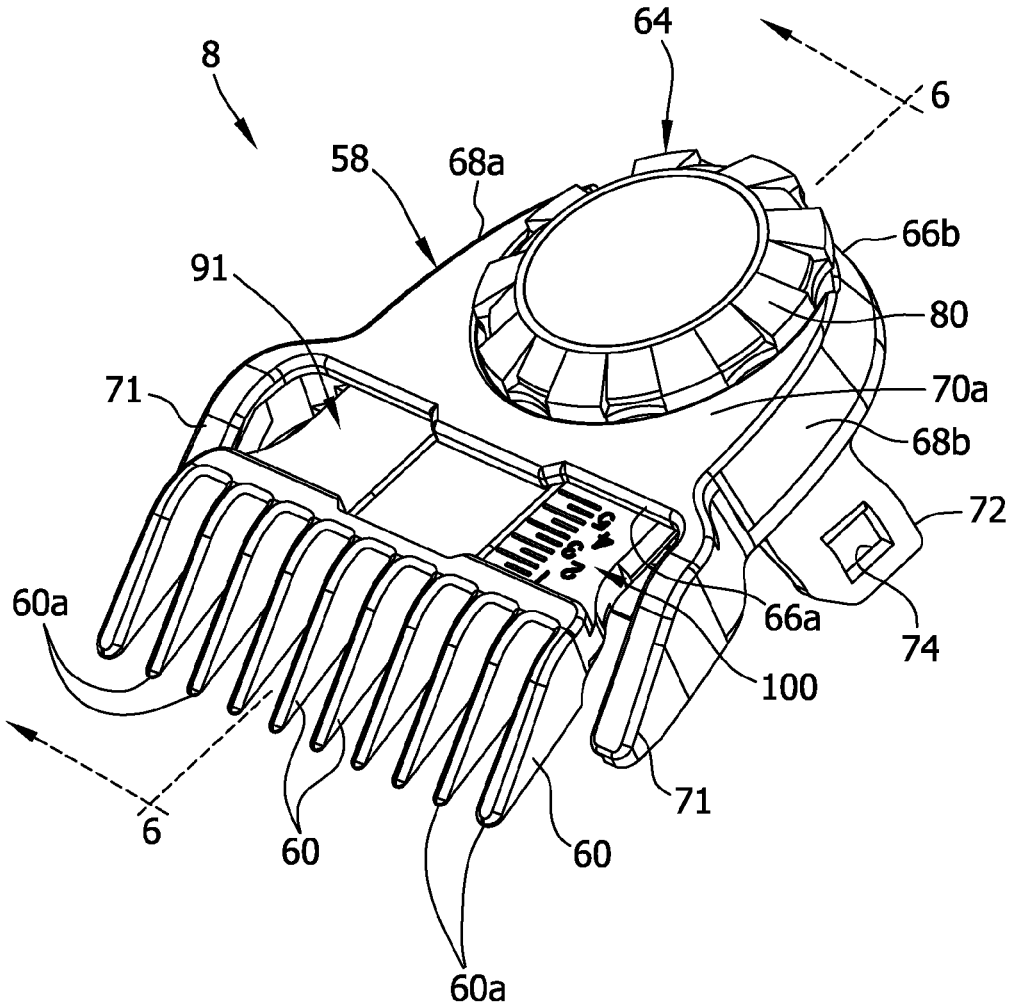
FIG. 4 is a perspective of the adjustable comb assembly, the adjustable comb assembly including teeth that are in a maximum haircut length position.
Figure 5:
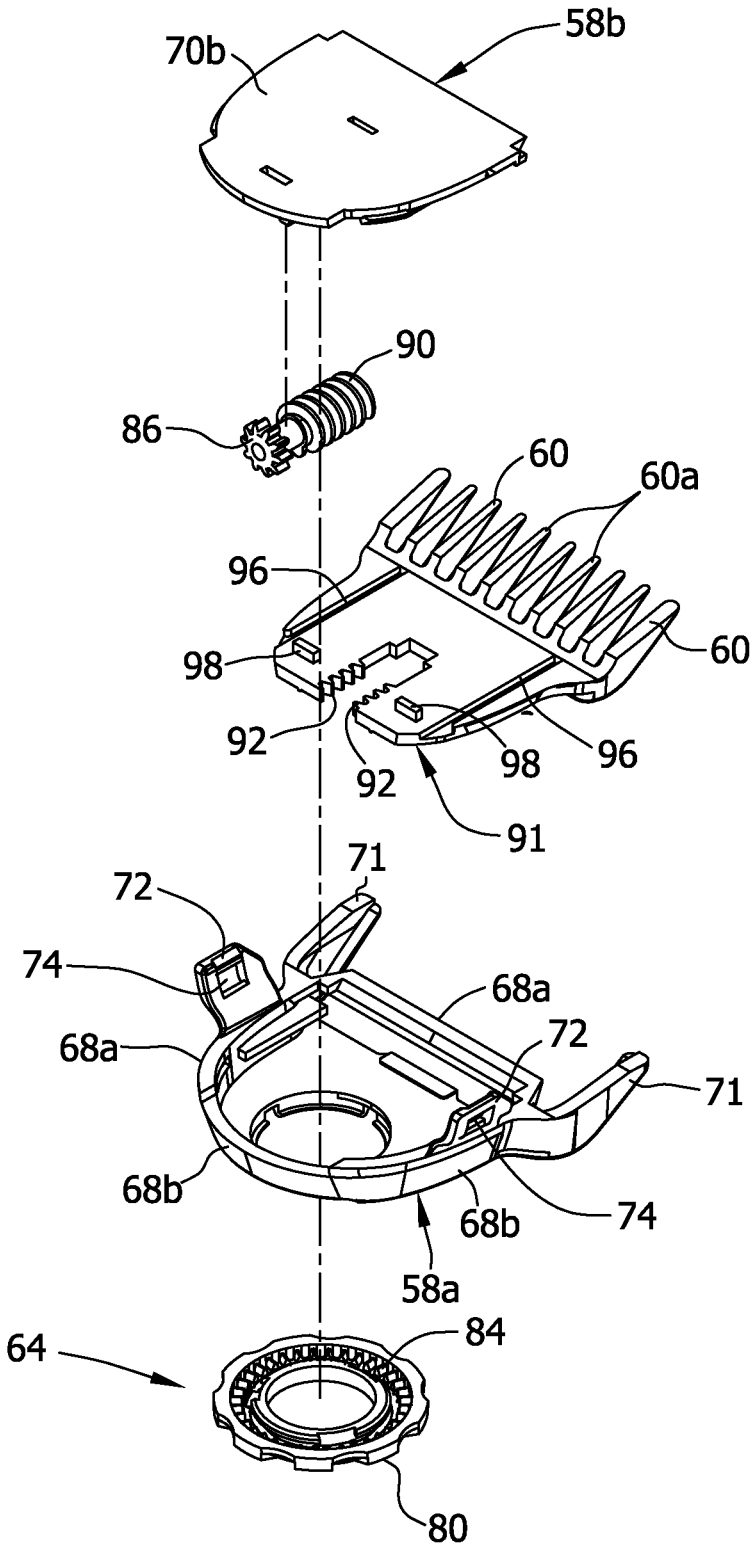
FIG. 5 is an exploded bottom perspective of the adjustable comb assembly of FIG. 4.

Corresponding reference characters indicate corresponding parts throughout the drawings. Terms used herein to describe relative positions of surfaces, structures, and components of the adjustable comb assembly are in accordance with the orientation of the adjustable comb assembly as illustrated in FIG. 4; these terms are non-limiting and used herein for descriptive purposes.

DETAILED DESCRIPTION OF THE DRAWINGS

Figure 1:
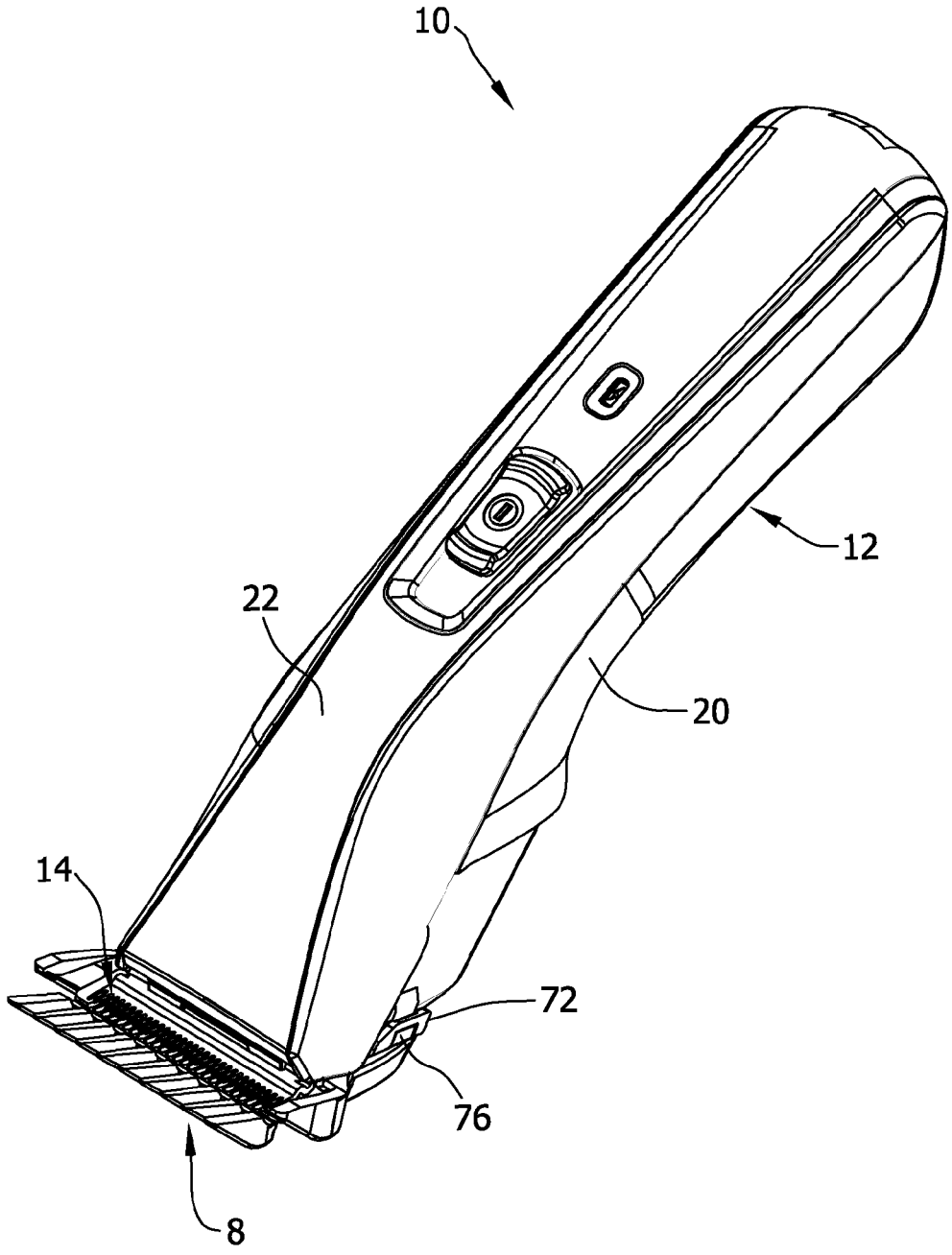
FIG. 1 is a perspective of one embodiment of a hair cutting appliance and an adjustable comb assembly attached to the hair cutting appliance.

Referring now to the drawings, an embodiment of an adjustable comb assembly is generally indicated at 8. The adjustable comb assembly 8 is suitable for use with a hair cutting appliance, generally indicated at 10 in FIGS. 1 and 2. In particular, the illustrated adjustable comb assembly 8 is suitable for use with the hair cutting appliance 10 that is configured as a hair trimmer to trim facial or body hair, although the adjustable comb assembly may be suitable for use with an appliance that is particularly configured for use as a hair clipper for clipping the hair on one's head or on a pet, or a shaver for shaving facial or body hair. The adjustable comb assembly 8 is configured for regulating a haircut length of hair that is cut by the hair cutting appliance 10. The illustrated adjustable comb assembly 8 is releasably attachable to the hair cutting appliance 10, although it is understood that the adjustable comb assembly 8 may be fixedly secured to (i.e., not removable from) and/or formed integrally with the hair cutting appliance without departing from the scope of the present invention.

A more detailed description of the illustrated hair cutting appliance 10 is set forth below with the understanding that the adjustable comb assembly 8 may be used with other types of hair cutting appliances, having different configurations, without departing from the scope of the present invention. The hair cutting appliance 10 comprises a housing, indicated generally at 12, a blade head assembly, indicated generally at 14, configured for cutting hair, and a drive assembly, indicated generally at 16 (FIG. 2), at least in part within the housing for operating the blade head assembly. The blade head assembly 14 is secured to the housing 12 by fasteners 18, or in other ways without departing from the scope of the present invention.

The illustrated housing 12, or a portion thereof, is suitably sized and shaped as a handle so that it is easily held in a user's hand. The housing 12 is elongate and is of two-piece construction including a base 20 and a cover 22 (see FIG. 1, the housing cover being removed in FIG. 2) affixed to the base to define an interior space of the housing. The illustrated housing base 20 and housing cover 22 may be constructed of a light-weight, rigid plastic, but it is contemplated that the base and/or cover could alternatively be made from other suitable materials. The housing 12 may be of another suitable construction and may be suitably shaped other than as illustrated.

Figure 2:
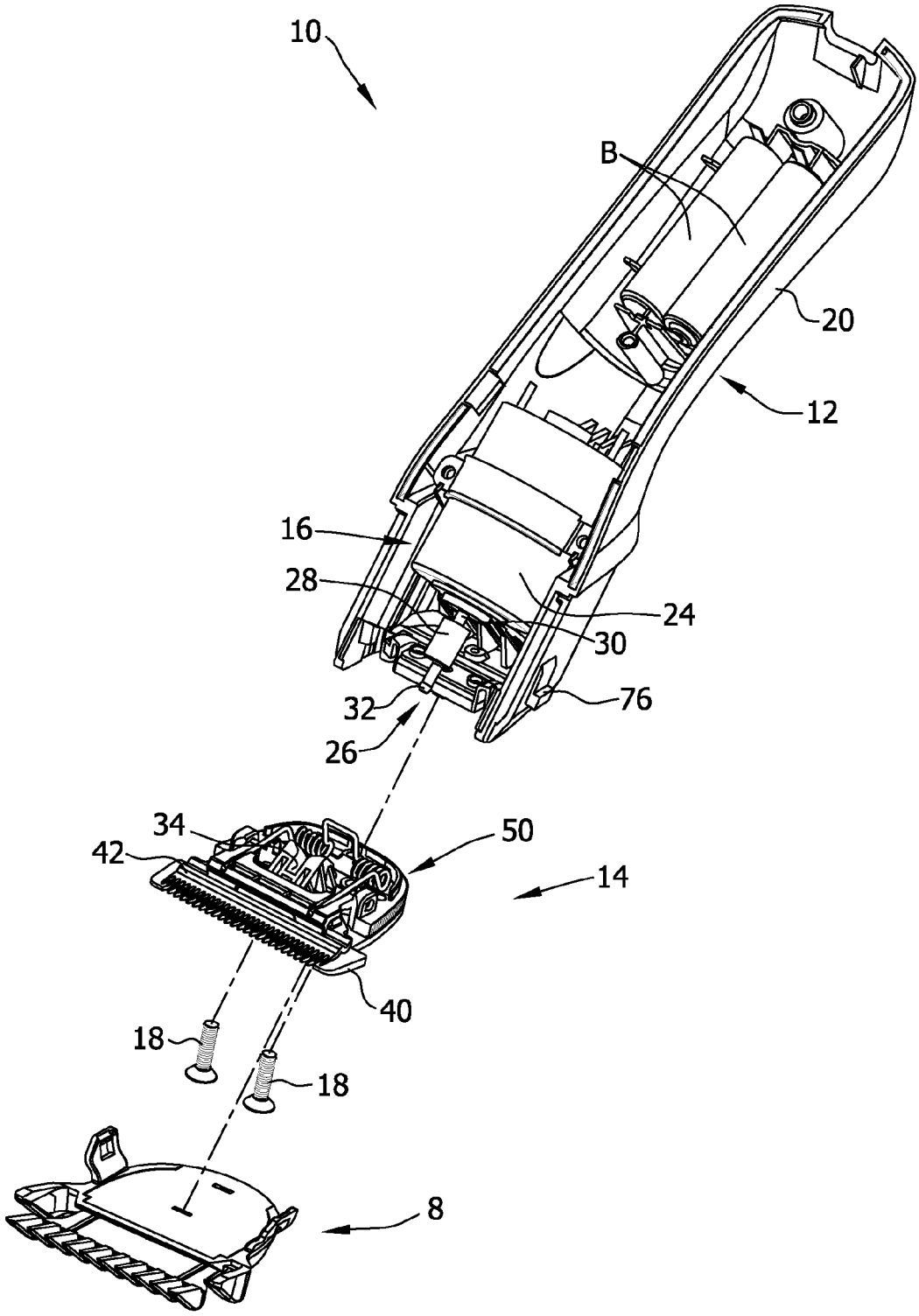
FIG. 2 is similar to FIG. 1 with the adjustable comb assembly removed from the hair cutting appliance, a portion of a housing of the appliance removed to show internal components, and a blade head assembly exploded from the housing.

Referring to FIG. 2, the illustrated drive assembly 16 generally comprises an electric drive motor 24 and an eccentric drive, generally indicated at 26, rotatably driven by the motor. The drive motor 24 may be powered by one or more batteries B within the housing and/or by another suitable internal or external electrical power source. In the illustrated embodiment, the eccentric drive 26 comprises a drive cylinder 28 operatively connected to an output shaft 30 of the motor 24, and an eccentric pin 32 that extends longitudinally outward from the drive cylinder at a location offset from the rotational axis of the output shaft. The eccentric pin 32 is received in a slot 34 of a coupling 36 associated with the blade head assembly 14 for driving the blade head assembly. It is understood that the hair cutting appliance 10 may include an alternative suitable drive assembly for driving the blade head assembly 14 without departing from the scope of this invention.

Figure 3:
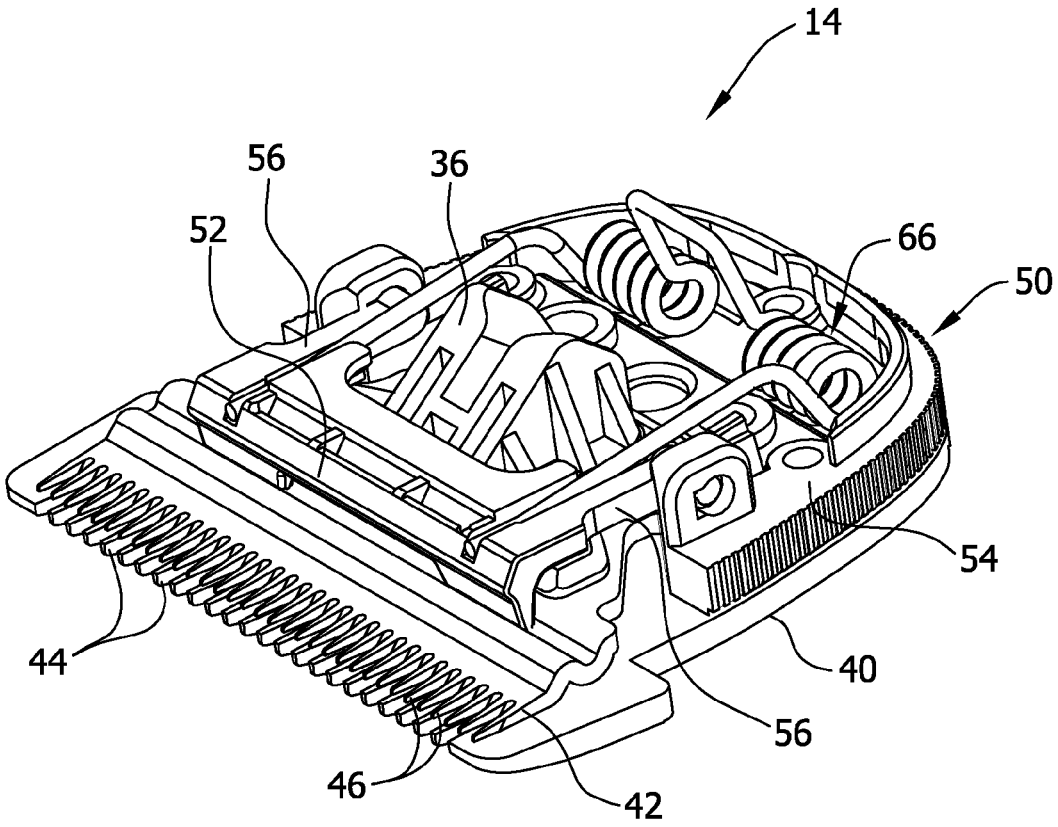
FIG. 3 is an enlarged perspective of the blade head assembly.

Referring to FIG. 3, the blade head assembly 14 generally comprises a blade 40 (broadly, a first blade) and a reciprocating blade 42 (broadly, a second blade). In the illustrated embodiment, the blade 40 is a stationary blade in that it remains stationary relative to the housing 12 during cutting operation of the appliance 10. It is understood, however, that the blade 40, along with the reciprocating blade 42, may reciprocate relative to the housing 12 without departing from the scope of the present invention. The stationary blade 40 and the reciprocating blade 42 each includes a plurality of shearing teeth 44, 46, respectively, adjacent a side of the corresponding blade. Together, the teeth 44, 36 define a cutting edge margin of the hair cutting appliance 10. The coupling 36 of the drive assembly 16 is secured to the reciprocating blade 42 for imparting reciprocating movement to the reciprocating blade.

The shearing teeth 46 of the reciprocating blade 42 are in face-to-face, sliding engagement with the shearing teeth 44 of the stationary blade 40 such that the shearing teeth of the reciprocating blade move across the shearing teeth of the stationary blade in a substantially linear cutting path (i.e., a straight cutting path). A blade clamping device, generally indicated at 50, holds the shearing teeth 46 of the reciprocating blade 42 in face-to-face, sliding engagement with the shearing teeth 44 of the stationary blade 40. The blade clamping device 50 generally comprises a clamping head 52 pivotally attached to a base 54 by a pair of arms 56, and a spring, generally indicated at 66, holding the clamping head in engagement with the reciprocating blade 42. The blades 40, 42 may be held in sliding engagement with one another in other ways without departing from the scope of the present invention. It is understood that in other embodiments, the shearing teeth 46 of the reciprocating blade 42 may move across the shearing teeth of the stationary blade 40 in a suitable cutting path that is not linear without departing from the scope of the present invention. Both the stationary blade 40 and the reciprocating blade 42 may be constructed from metal, such as stainless steel, although it is understood that one or each of the blades 40, 42 may be constructed from other types of material, such as ceramic.

Referring to FIGS. 4-8, the illustrated adjustable comb assembly 8 comprises a body, generally indicated at 58, a plurality of movable teeth 60, and a drive assembly, generally indicated at 64, for selectively moving the teeth relative to the body to a desired haircut length position, as explained in more detail below. The body 58 includes an upper casing, generally indicated at 58*a*, and a lower plate, generally indicated at 58*b*, secured to the upper casing to enclose the drive assembly 64 in the body. The body 58 has a generally low profile with opposite front and rear ends 66*a*, 66*b*, respectively, opposite left and right sides, 68*a*, 68*b*, respectively, and opposite upper and lower faces 70*a*, 70*b*, respectively. A pair of fixed side guards 71 extend generally forward from the opposite left and right sides 68*a*, 68*b* of the body 58. The side guards 71 cover the sides of the blades 40, 42 at the cutting edge margin when the comb assembly 8 is attached to the hair cutting appliance 10.

An attachment component, in the form of left and right tabs 72 depending from respective sides 68*a*, 68*b* of the comb assembly body 58, is used to removably and repeatedly attach the comb assembly 8 to the hair cutting appliance 10, and more particularly, to the blade head assembly 14. The tabs 72 are resiliently deflectable in a direction laterally outward from the body 58 and have openings 74 that receive rigid hook members 76 on the housing 12 of the hair cutting appliance 10 (FIGS. 1 and 2) when the comb assembly 8 is positioned on the blade head assembly 14. The comb assembly 8 is removable from the blade head assembly 14 by resiliently deflecting the tabs 72 such that the hook members are withdrawn from the openings 74. Other ways of making the adjustable comb assembly 8 removably and repeatedly attachable to the hair cutting appliance 10 do not depart from the scope of the present invention. Moreover, as set forth above, the adjustable comb assembly 8 may be fixedly secured to (i.e., not removable from) and/or formed integrally with the hair cutting appliance without departing from the scope of the present invention.

When the comb assembly 8 is attached to the hair cutting appliance 10, at least portions of the teeth 60 are positioned above the cutting edge margin of the hair cutting appliance. In the illustrated embodiment, the teeth 60 are generally in the form of spaced apart teeth having lengths extending outward from the front end 66*a* of the body 58 in a direction generally parallel to the upper and lower faces 70*a*, 70*b*. The teeth 60 are generally uniform in size and shape and taper along their respective lengths toward free ends 60*a* of the teeth. As explained in more detail below, the teeth 60 are movable, as a unit, generally within a displacement plane extending forward from the front end 66*a* of the body 58 and generally parallel to the shearing teeth 44, 46 of the blades 40, 42. It is understood, however, that the adjustable comb assembly 8 may be configured such that the teeth 60 are movable, as a unit, within a plane extending generally upward from the upper face 70*a* and generally orthogonal to the shearing teeth 44, 46, without departing from the scope of the present invention.

In the illustrated embodiment, the drive assembly 64 allows a user to selectively position the teeth 60 relative to the cutting edge margin of the hair cutting appliance 10 in any one of a substantially infinite number of different haircut length positions within a range from a maximum haircut length position, which facilitates cutting hair to a maximum haircut length, to the minimum haircut length position, which facilitates cutting hair to a minimum haircut length. Through this configuration, the haircut length may be selectively adjustable to any one of a substantially infinite number of different haircut lengths within a range from the maximum haircut length to the minimum haircut length. It is understood, however, that in other embodiments the teeth 60 may be positioned in any one of a plurality of discrete haircut length positions from the maximum haircut length position to the minimum haircut length position, without departing from the scope of the present invention. In the illustrated embodiment, the teeth 60 are positioned in the maximum haircut length position when the free ends 60*a* of the teeth are spaced a maximum laterally outward distance from the cutting edge margin of the hair cutting appliance 10. Likewise, the teeth 60 are positioned in the minimum haircut length position when the free ends 60*a* of the teeth are spaced a minimum laterally outward distance from the cutting edge margin of the hair cutting appliance 10. Other configurations do not depart from the scope of the present invention.

As set forth above, the drive assembly 64 is adapted to allow selective movement of the teeth 60 relative to the body 58 to a desired haircut length position. Referring to FIGS. 5-8, the illustrated drive assembly 64 is manually operated and includes a manually operable actuator 80, in the form of a knob, on the upper face 70*a* of the body 58 of the comb assembly 8. The knob 80 (broadly, a drive actuator) is rotatably secured to the body 58 and is sized and shaped for rotation by a hand of a user. As explained in more detail below, rotation of the knob 80 imparts linear movement of the teeth 60 within the displacement plane to position the teeth in the selected haircut length position. More specifically, the drive assembly 64 facilitates both forward and rearward movement of the teeth 60 relative to the body 58 and the cutting edge margin of the hair cutting appliance. The drive assembly 64 may include a different drive actuator, other than the illustrated rotatable knob 80, without departing from the scope of the present invention. Moreover, the drive assembly 64 may be operated automatically, such as by a motor or other device, rather than manually.

The rotatable knob 80 is operably coupled to an input member 84, which in the illustrated embodiment, is in the form of a crown gear (also known as a contrate gear). In the illustrated embodiment, the crown gear 84 is fixedly secured to the rotatable knob 80, and may be formed integrally therewith, such that the crown gear 84 rotates with the knob. The crown gear 84 operatively engages a spur gear 86 such that rotation of the crown gear 84 imparts rotation to the spur gear 86. The spur gear 86 is fixedly secured to, and may be formed integrally with, a worm screw 90, such that rotation of the spur gear imparts axial rotation to the worm screw. In turn, the worm screw 90 operatively engages a rack gear, generally indicated at 91. In the illustrated embodiment, the rack gear 91 comprising opposing sets of linear rack teeth 92. The worm screw 90 is disposed between the sets of linear rack teeth 92, and in engagement therewith, such that rotation of the worm screw about its axis imparts linear movement of the rack gear 91. The rack gear 91 is telescopingly secured inside the body 58 such that the rack gear translates within the displacement plane. In particular, the body 58 includes ribs 94 on the lower plate 58*b* which define a track on which the rack gear 92 slides. The ribs 94 are received in grooves 96 on the underside of the rack gear 91. The rack gear 91 slides along the ribs 94, and the ribs inhibit the rack gear from laterally deviating from the displacement plane. Stops 98 on the underside of the rack gear 91 limit the displacement of the rack gear relative to the body 58 of the comb assembly 8 so that the rack gear does not disengage the worm screw 90 and become detached from the body. The teeth 60 are fixedly secured to an end of the rack 91 that extends outside the body 58, generally adjacent to the front end 66*a* of the body, such that the teeth translate with the rack gear. The driving assembly 64 may be of other configurations without departing from the scope of the present invention.

Together, the worm screw 90 and the rack gear 91 form a rack-and-pinion transmission (broadly, a linear actuator) for converting rotational movement of the input crown gear 84 into linear movement of the teeth 60. In one embodiment, the worm screw 90 and the rack gear 91 are configured such that the rack-and-pinion transmission is self-locking. In other words, the rack-and-pinion transmission is irreversible, where the worm screw 90 can drive the rack gear 91, but the rack gear cannot drive the worm screw. In one example, the rack-and-pinion transmission is self-locking where the worm screw 90 and the rack gear 91 are configured so that the lead angle of the worm screw is less than the friction angle, and as a consequence, the efficiency for reversed driving is zero. Because the rack-and-pinion transmission is self-locking, the position of the teeth 60 are substantially maintained in the selected haircut length position until the knob 80 is rotated to move the teeth either forward or rearward relative to the body 58 and the cutting edge margin of the hair cutting appliance 10. Thus, the teeth 60 will remain substantially in the selected haircut position even if forces are applied to the teeth during use of the hair cutting appliance 10. The driving assembly 64 may have a different suitable type of, or a different suitable configuration for, the linear actuator. It is also understood that the driving assembly 64 may not include a linear actuator and remain within the scope of the present invention. Moreover, in addition to or in replace of the self-locking linear actuator, the comb assembly 8 may include a locking mechanism for selectively locking the haircut length position of the teeth 60, and requiring the locking mechanism to be unlocked before the haircut length position of the teeth can be adjusted.

As disclosed above, the illustrated comb assembly 8 allows a user to selectively adjust the haircut length to any one of a substantially infinite number of different haircut lengths within a range from the maximum haircut length to the minimum haircut length. Thus, the user can select substantially any haircut length within the range defined by the maximum and minimum haircut length. In one example, the comb assembly 8 may be configured to facilitate a maximum haircut length from about 4.0 mm to about 7.0 mm, more specifically, from about 4.5 mm to about 6.5 mm, or from about 5.0 mm to about 6.0 mm, or to about 5.5 mm. In this same example, the comb assembly 8 may be configured to facilitate a minimum haircut length from about 0.0 mm to about 1.0 mm, and more specifically, from about 0.2 mm to about 0.8 mm, or from about 0.3 mm to about 0.6 mm, or to about 0.4 mm. Any combinations of the maximum haircut length ranges and the minimum haircut length ranges are possible. In a suitable example, the maximum haircut length may be about 5.5 mm and the minimum haircut length may be about 0.4 mm. This exemplary haircut length range (i.e., 5.5 mm to 0.4 mm) may be particularly suitable for a facial hair trimmer, such as the illustrated hair cutting appliance 10. Other haircut length ranges do not depart from the scope of the present invention.

Figure 6:
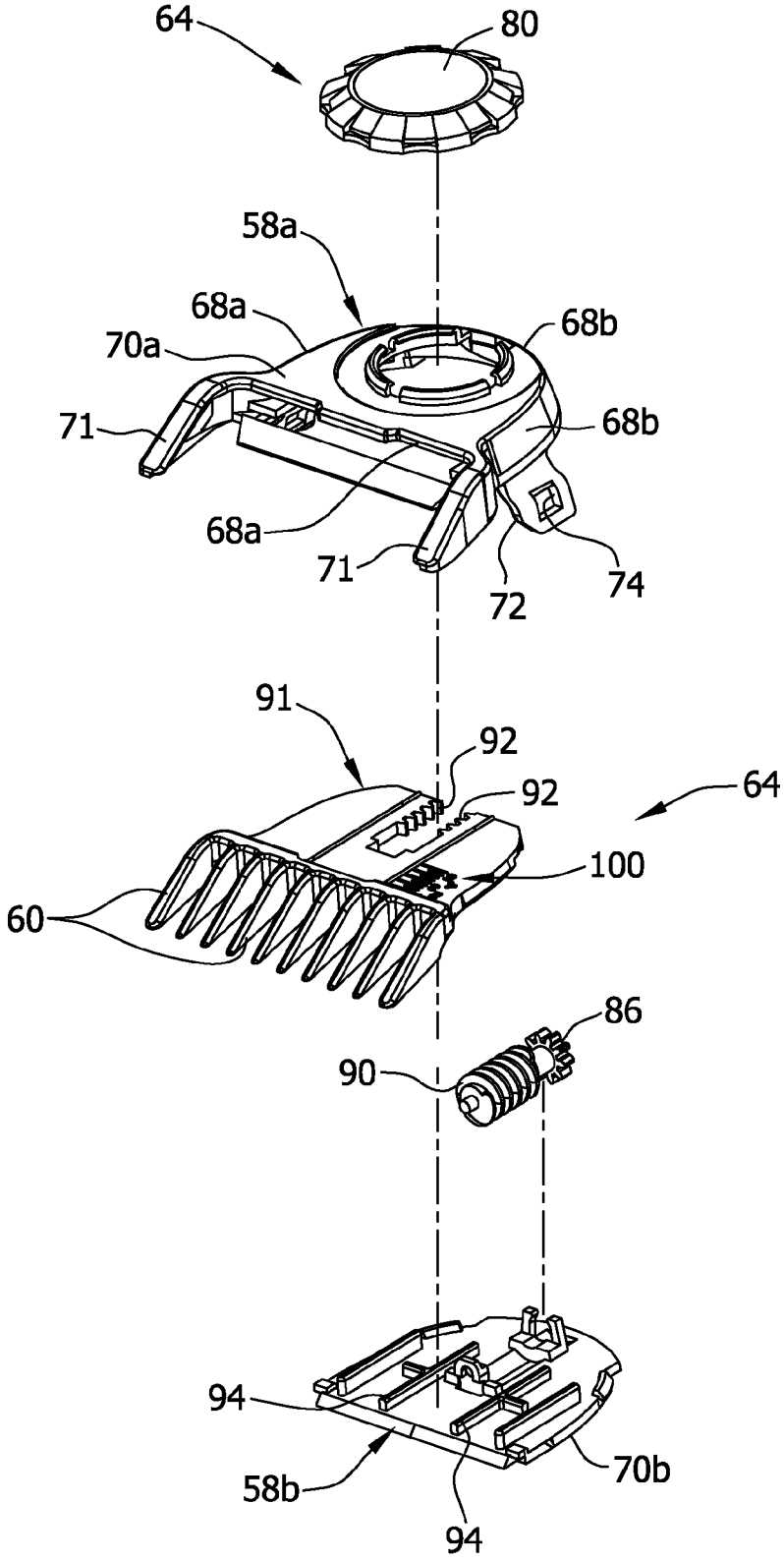
FIG. 6 is an exploded top perspective of the adjustable comb assembly of FIG. 4.
Figure 7:
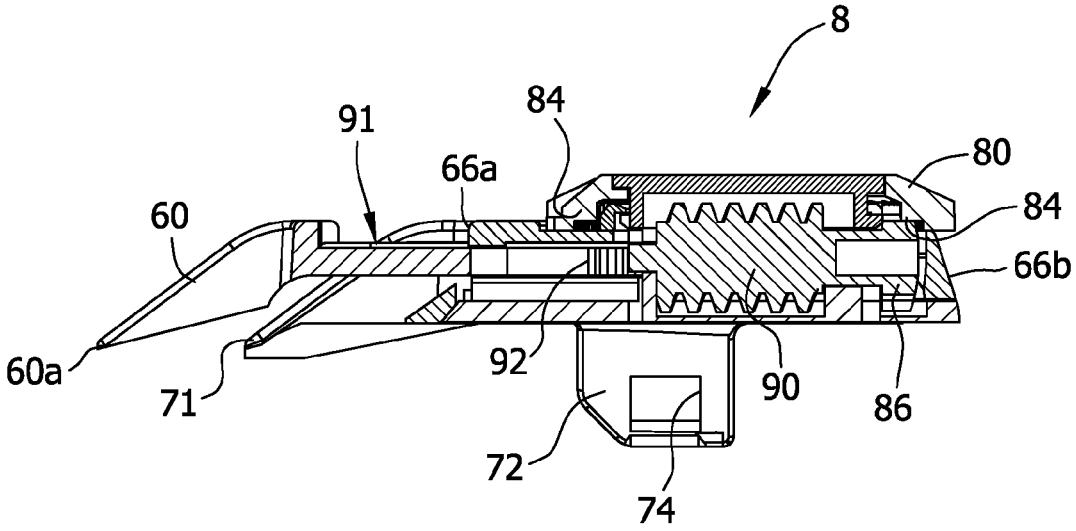
FIG. 7 is a sectional view of the adjustable comb assembly of FIG. 4 taken along the line 6-6 in FIG. 4.
Figure 8:
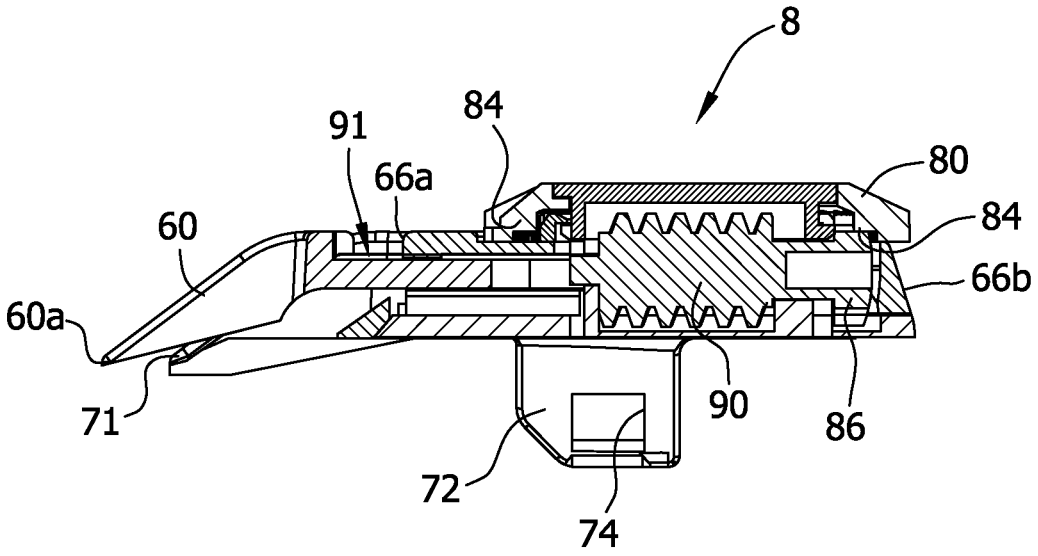
FIG. 8 is similar to FIG. 7, except that the teeth of the adjustable comb are in a minimum haircut length position.

Referring to FIGS. 4 and 6, the illustrated comb assembly 8 also includes haircut length indicia, generally indicated at 100, for indicating some of the infinite number of haircut length positions of the teeth 60. The haircut length indicia 100 can be used to select a desired haircut length and/or to approximate the desired haircut length. In the illustrated embodiment, the haircut length indicia 100 are on the rack gear 91 or some component that moves with the rack gear. In particular, the haircut length indicia are on an upper surface of a portion of the rack gear 91 that is extendable outside the body 58 of the comb assembly 8. The haircut length indicia 100 are in the form of a sliding scale having numerical intervals of the selectable haircut lengths. As the rack gear 91 is moved out of the body 58, the numerals and associated lines corresponding to the haircut length positions of the teeth are exposed and viewable by the user. Other ways of indicating the haircut length position of the teeth 60 do not depart from the scope of the present invention.

When introducing elements of the present invention or preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. An adjustable comb assembly attachable to an electric hair cutting appliance including opposing cutting blades having a plurality of shearing teeth each with a length and collectively defining a cutting edge margin for cutting hair, the adjustable comb assembly comprising:

a plurality of comb teeth for regulating a haircut length resulting from the hair being cut by the cutting edge margin of the electric hair cutting appliance;

a drive assembly comprising a rotatable drive actuator, a linear actuator operatively connected to the comb teeth for selectively moving the comb teeth generally along the lengths of the shearing teeth, and a plurality of drive members disposed operatively between the drive actuator and the linear actuator for transferring motion from the drive actuator to the linears actuator, wherein the drive members are movable relative to one another; and an attachment component configured for removably attaching the adjustable comb assembly to the electric hair cutting appliance such that the comb teeth, together with the drive assembly, are removable from the electric hair cutting appliance, and such that the comb teeth are movable relative to the attachment component via the drive assembly, wherein, when the adjustable comb assembly is attached to the electric hair cutting appliance, the comb teeth are selectively movable relative to the cutting edge margin of the electric hair cutting appliance via the drive assembly to any one of a plurality of different haircut length positions within a range from a maximum haircut length position, in which the adjustable comb assembly facilitates cutting hair to a maximum haircut length, to a minimum haircut length position, in which the adjustable comb assembly facilitates cutting hair to a minimum haircut length, to thereby allow selective adjustment of the haircut length to any one of a plurality of different haircut lengths within a range from the maximum haircut length to the minimum haircut length.

2. The adjustable comb assembly set forth in claim 1 wherein the plurality of drive members comprises a plurality of rotatable gears.

3. The adjustable comb assembly set forth in claim 2 wherein the linear actuator comprises a rack-and-pinion transmission.

4. The adjustable comb assembly set forth in claim 3 wherein the pinion of the rack-and-pinion transmission comprises a worm screw.

5. The adjustable comb assembly set forth in claim 4 wherein the rack-and-pinion transmission is self-locking.

6. The adjustable comb assembly set forth in claim 5 wherein the rack of the rack-and-pinion transmission comprises two spaced apart and opposing sets of linear rack teeth, and wherein the worm screw is disposed between and in operative engagement with the sets of linear rack teeth.

7. The adjustable comb assembly set forth in claim 1 wherein the drive assembly is manually operable.

8. The adjustable comb assembly set forth in claim 7 wherein the drive actuator is a knob adapted to facilitate manual operation of the drive assembly.

9. The adjustable comb assembly set forth in claim 1 wherein the maximum haircut length is from about 4.0 mm to about 7.0 mm, and the minimum haircut length is from about 0.0 mm to about 1.0 mm.

10. The adjustable comb assembly set forth in claim 1 wherein the maximum haircut length is from about 5.0 mm to about 6.0 mm, and the minimum haircut length is from about 0.2 mm to about 0.6 mm.

11. The adjustable comb assembly set forth in claim 1 further comprising haircut length indicia corresponding to at least some of the different haircut length positions for indicating an instantaneous haircut length position of the comb teeth.

12. The adjustable comb assembly set forth in claim 1 in combination with the electric hair cutting appliance.

13. An adjustable comb assembly attachable to an electric hair cutting appliance including opposing cutting blades having a plurality of shearing teeth each with a length and collectively defining a cutting edge margin for cutting hair, the adjustable comb assembly comprising:

a plurality of comb teeth for regulating a haircut length resulting from the hair being cut by the cutting edge margin of the electric hair cutting appliance, wherein when the adjustable comb assembly is attached to the electric hair cutting appliance, the comb teeth are selectively movable relative to the cutting edge margin of the electric hair cutting appliance to any one of a plurality of different haircut length positions within a range from a maximum haircut length position, in which the adjustable comb assembly facilitates cutting hair to a maximum haircut length, to a minimum haircut length position, in which the adjustable comb assembly facilitates cutting hair to a minimum haircut length, to thereby allow selective adjustment of the haircut length to any one of a plurality of different haircut lengths within a range from the maximum haircut length to the minimum haircut length;

a drive assembly for selectively moving the comb teeth to any one of the plurality of different haircut length positions within the range from the maximum haircut length position to the minimum haircut length position, the drive assembly including a rack-and-pinion transmission operatively connected to the comb teeth for selectively moving the comb teeth generally along the lengths of the shearing teeth, wherein the pinion of the rack-and-pinion transmission includes a worm screw; and an attachment component configured for removably attaching the adjustable comb assembly to the electric hair cutting appliance such that the comb teeth, together with the drive assembly, are removable from the electric hair cutting appliance.

14. The adjustable comb assembly set forth in claim 13 wherein the rack-and-pinion transmission is self-locking.

15. The adjustable comb assembly set forth in claim 14 wherein the drive assembly further includes a rotatable input member operatively connected to the worm screw for imparting rotational movement to the worm screw.

16. The adjustable comb assembly set forth in claim 15 wherein the rack of the rack-and-pinion transmission comprises two spaced apart and opposing sets of linear rack teeth, and wherein the worm screw is disposed between and in operative engagement with the sets of linear rack teeth.

17. The adjustable comb assembly set forth in claim 14 further comprising a body in which the rack-and-pinion transmission is received, wherein the comb teeth are selectively movable relative to the body.

18. The adjustable comb assembly set forth in claim 14 further comprising haircut length indicia corresponding to at least some of the haircut length positions for indicating an instantaneous haircut length position of the comb teeth.

19. The adjustable comb assembly set forth in claim 18 wherein the haircut length indicia is associated with the rack of the rack-and-pinion transmission.

20. The adjustable comb assembly set forth in claim 13 further comprising a rotatable knob for actuating operation of the drive assembly.

21. The adjustable comb assembly set forth in claim 13 wherein the maximum haircut length is from about 4.0 mm to about 7.0 mm, and the minimum haircut length is from about 0.0 mm to about 1.0 mm.

22. The adjustable comb assembly set forth in claim 13 wherein the maximum haircut length is from about 5.0 mm to about 6.0 mm, and the minimum haircut length is from about 0.2 mm to about 0.6 mm.

23. The adjustable comb assembly set forth in claim 13 in combination with the electric hair cutting appliance.

24. A hair cutting system for cutting hair to a selected haircut length, the hair cutting system comprising:

an electric hair cutting appliance comprising:

a housing having a hair cutting end;

an electric motor disposed within the housing; and at least two opposing cutting blades at the hair cutting end of the housing, the cutting blades having a plurality of shearing teeth each with a length and collectively defining a cutting edge margin of the hair cutting appliance, wherein at least one of the cutting blades is operatively connected to the electric motor and is adapted for reciprocating movement relative to the other cutting blade for cutting hair at the cutting edge margin; and an adjustable comb assembly including:

a plurality of comb teeth for regulating a haircut length resulting from the hair being cut by the cutting edge margin of the electric hair cutting appliance, wherein when the adjustable comb assembly is attached to the electric hair cutting appliance, the comb teeth are selectively movable relative to the cutting edge margin of the electric hair cutting appliance to any one of a plurality of different haircut length positions within a range from a maximum haircut length position, in which the comb assembly facilitates cutting hair to a maximum haircut length, to a minimum haircut length position, in which the adjustable comb assembly facilitates cutting hair to a minimum haircut length, to thereby allow selective adjustment of the haircut length to any one of a plurality of different haircut lengths within a range from the maximum haircut length to the minimum haircut length;

a drive assembly for selectively moving the comb teeth to any one of the different haircut length positions within the range from the maximum haircut length position to the minimum haircut length position, the drive assembly including a drive actuator and a plurality of drive members, the drive actuator operatively connected to the comb teeth by the plurality of drive members for selectively moving the comb teeth generally along the lengths of the shearing teeth, wherein plurality of drive members comprises a first gear and a second gear that are meshed together, the first gear having less gear teeth than the second gear; and an attachment component configured for removably attaching the adjustable comb assembly to the electric hair cutting appliance such that the comb teeth, together with the drive assembly, are removable from the electric hair cutting appliance.

25. The hair cutting system set forth in claim 24 wherein the second gear is configured to drive the first gear.

26. The hair cutting system set forth in claim 25 wherein the adjustable comb assembly further comprises a body, the plurality of comb teeth being movable relative to the body, wherein at least a portion of the drive assembly is disposed within the body of the adjustable comb assembly.

* * * * *